US006019291A

United States Patent [19]

Tankersley

[11] Patent Number: 6,019,291

[45] Date of Patent: Feb. 1, 2000

[54] FLUID KNIFE

[75] Inventor: Patrick L. Tankersley, Novi, Mich.

[73] Assignee: B. W. Vortex, Inc., Livonia, Mich.

[21] Appl. No.: 09/073,573

[22] Filed: May 6, 1998

Related U.S. Application Data

[60] Provisional application No. 60/045,926, May 7, 1997.

[51] Int. Cl.[7] ..... B05B 15/02; B05B 1/32

[52] U.S. Cl. ..... 239/107; 239/451

[58] Field of Search ..... 239/451, 455, 239/592, DIG. 8, 107; 118/63

[56] References Cited

U.S. PATENT DOCUMENTS

| | | | |
|---|---|---|---|
| 3,272,176 | 9/1966 | Saydlowski | 118/63 |
| 3,753,418 | 8/1973 | Roncan | 118/63 |
| 3,935,041 | 1/1976 | Goffredo et al. | 156/18 |
| 4,270,317 | 6/1981 | Kurie | 51/426 |
| 4,513,915 | 4/1985 | Kohler et al. | 239/455 |
| 4,515,313 | 5/1985 | Cavanagh | 239/455 |
| 5,188,135 | 2/1993 | Newmann et al. | 134/64 R |
| 5,709,750 | 1/1998 | Schiefer | 239/455 X |
| 5,858,096 | 1/1999 | Madrzak et al. | 239/455 X |

*Primary Examiner*—Andres Kashnikow
*Assistant Examiner*—Sean P. O'Hanlon
*Attorney, Agent, or Firm*—Bliss McGlynn, P.C.

[57] ABSTRACT

A fluid knife for use with a workpiece treatment/cleaning apparatus, the fluid knife including a front blade and a bottom blade cooperating to form a nozzle. The front blade is pivotally mounted whereby pivoting the blade increases the size of the nozzle to purge the nozzle of any particulate matter caught or trapped in the nozzle.

19 Claims, 8 Drawing Sheets

FLUID KNIFE

This application claims benefit of Provisional Application 60/045,926 filed on May 7, 1997.

BACKGROUND OF THE INVENTION

1. Field of the Invention

The present invention relates to a fluid knife for use with a treatment system used to clean or treat a workpiece. More specifically, the invention relates to a fluid knife having a purge feature to clear the nozzle.

2. Description of the Related Art

Prior to using a sheet of metal, such as steel or aluminum, in a variety of manufacturing processes and products, the sheet or workpiece as it is often referred to, either in the form of a continuous strip or a blank, is typically cleaned and/or treated. For instance, the workpiece may be plated, galvanized, descaled or pickled. Additionally, the workpiece may be washed, rinsed or otherwise treated in some other manner for subsequent operation.

Systems are available for cleaning or otherwise treating the workpiece. Such systems include a plurality of spray heads or brushes that contact the surface of the workpiece and in a cleaning operation, remove any foreign or particulate matter from the surface of the workpiece. Fluid knives have been used at the inlet and outlet of the apparatus to contain or confine the cleaning fluid within the apparatus. In addition, wringer rollers may be used to remove excess fluid from the workpiece and to drive the workpiece through the machine. The fluid used in the system is contained and is continually reused. Thus, the system operates in a closed environment wherein fluid exiting the fluid knives and the spray nozzles is collected, filtered and reused. While filtering removes most of the debris from the fluid, occasionally debris or other particulate matter finds its way into the fluid knife and becomes lodged in the opening of the fluid knife. When debris becomes lodged in the opening, it prevents fluid from exiting the fluid knife. Blockage of the nozzle opening causes streaking on the workpiece and also allows unwanted material to escape the enclosure. Additionally, if the fluid knife fails to maintain a continuous sheet of fluid striking the workpiece, cleaning or treatment fluid may escape through the gap created by the blockage.

SUMMARY OF THE INVENTION

The present invention is a fluid knife for use in the treatment or cleaning of a continuously moving workpiece, such as a sheet or continuous coil of metal, traveling through either a treatment operation or a washing/cleaning operation.

The fluid knife includes a front blade and a bottom blade. The front and bottom blade cooperate to form a nozzle. Fluid exiting through the nozzle strikes the workpiece and performs three functions; first it cleans the workpiece, second it removes any excess fluid from the workpiece thereby reducing drag-out from tank to tank, and third it contains fluid and turbulence within the system.

The front blade is pivotally attached to a plenum. Pivoting the blade increases the size of the nozzle to purge the nozzle of any particulate matter caught or trapped in the nozzle. The assembly for pivoting the front blade includes a power cylinder attached to the top surface of the plenum. The power cylinder is connected to the blade such that actuation of the power cylinder pivots the front blade about discreet pivotal mounting points connecting the front blade to the plenum. Pivotal mounting provides two functions; first, the size or the opening of the nozzle is easily varied and second, the nozzle can be opened to purge any particulate trapped in the nozzle, thus improving the cleaning and stripping abilities of the fluid knife. Purging cleans the fluid knife and reduces the maintenance and corresponding down time of the cleaning or treatment system.

Other features and advantages of the present invention will be readily appreciated as the same becomes better understood after reading the subsequent description taken in conjunction with the accompanying drawings.

DETAILED DESCRIPTION OF THE PREFERRED EMBODIMENT(S)

Figure 1:
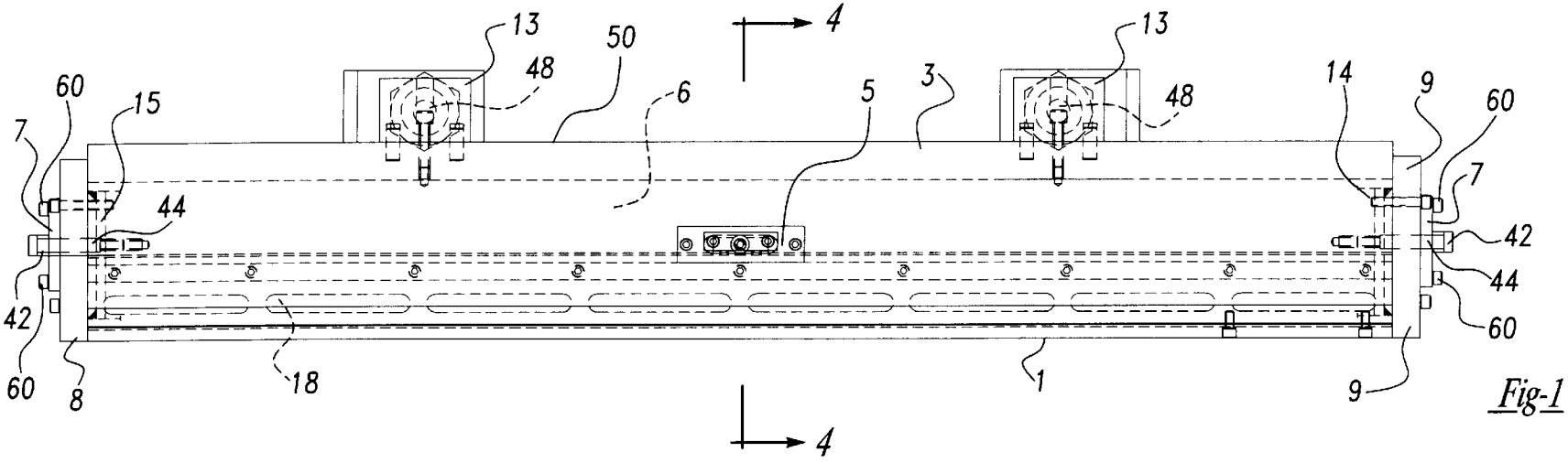
FIG. 1 is a front view of a fluid knife according to the present invention.
Figure 2:
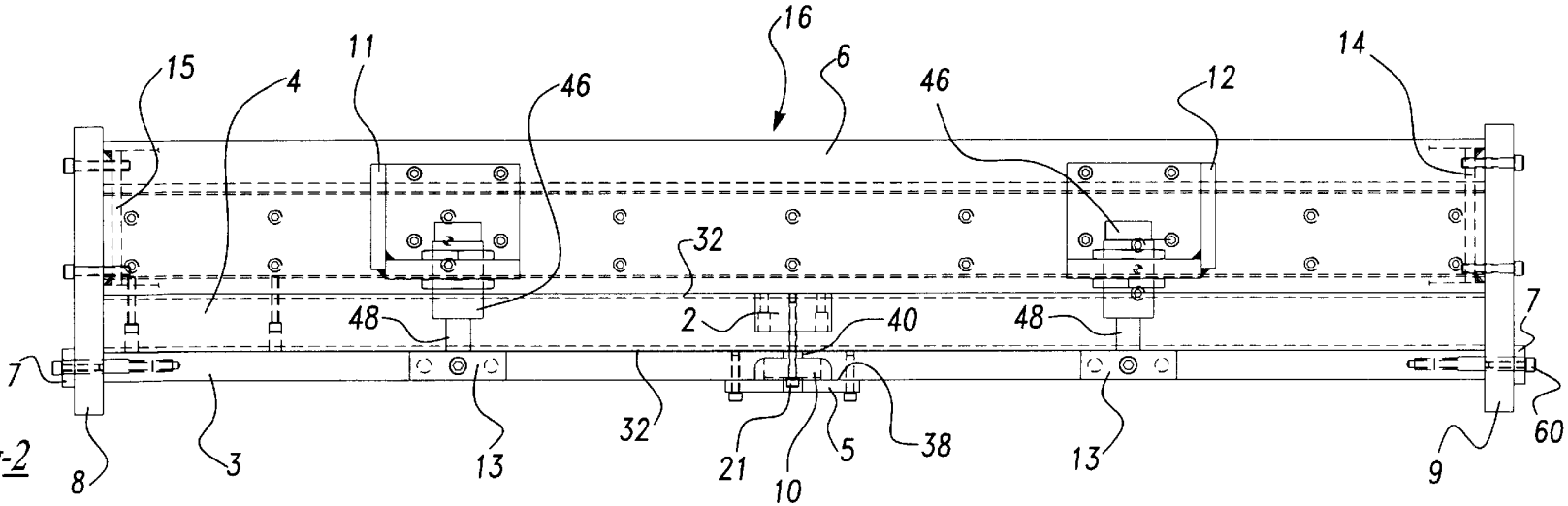
FIG. 2 is a top view of the fluid knife of FIG. 1.
Figure 3:
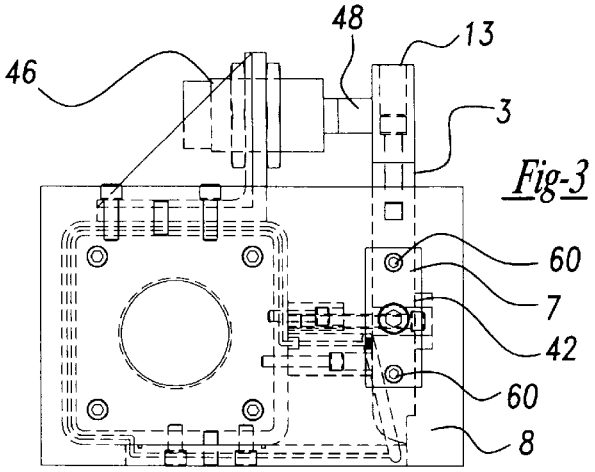
FIG. 3 is an end view of the fluid knife of FIG. 1.
Figure 4:
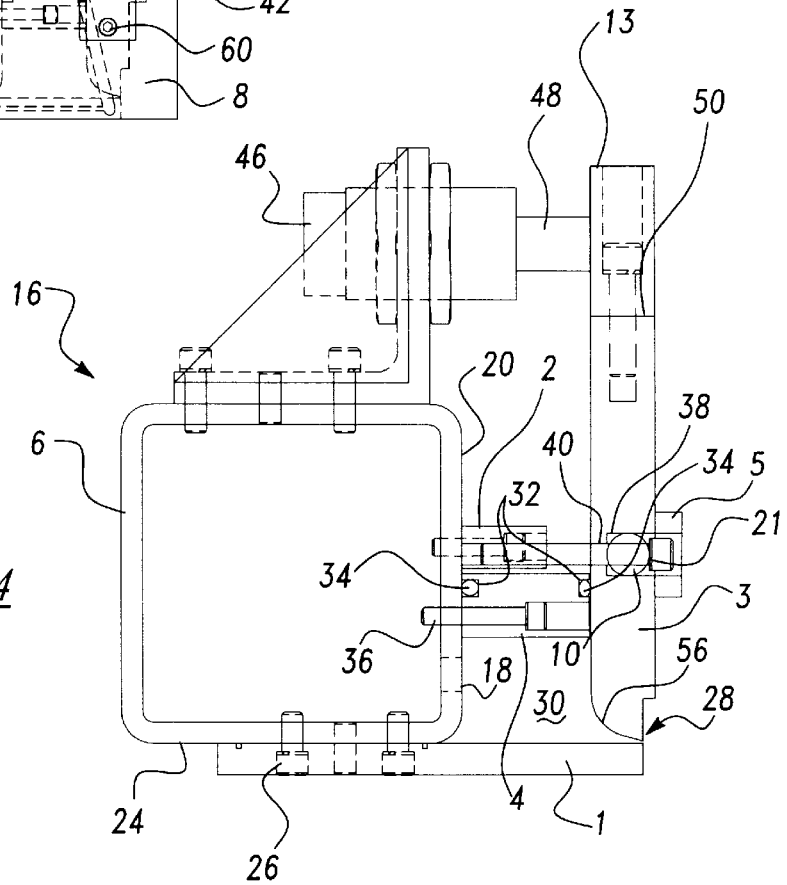
FIG. 4 is a cross-sectional view taken along lines 4—4 of FIG. 1.
Figure 9A:
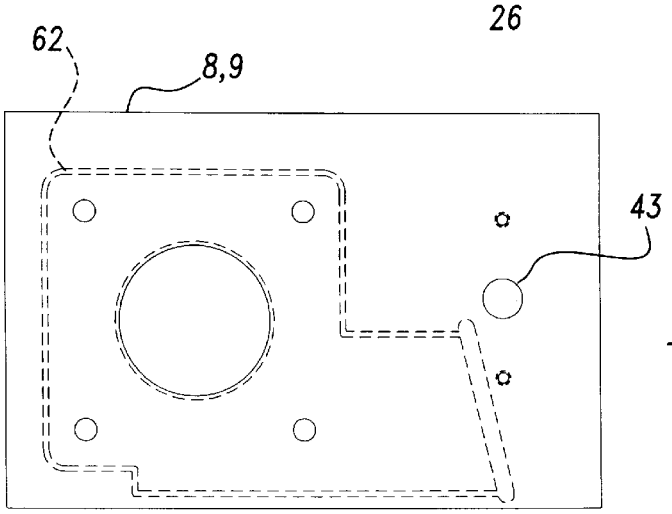
FIGS. 9*a*–9*b* show respective side and front views of an end cap of the fluid knife according to the present invention.
Figure 5A:
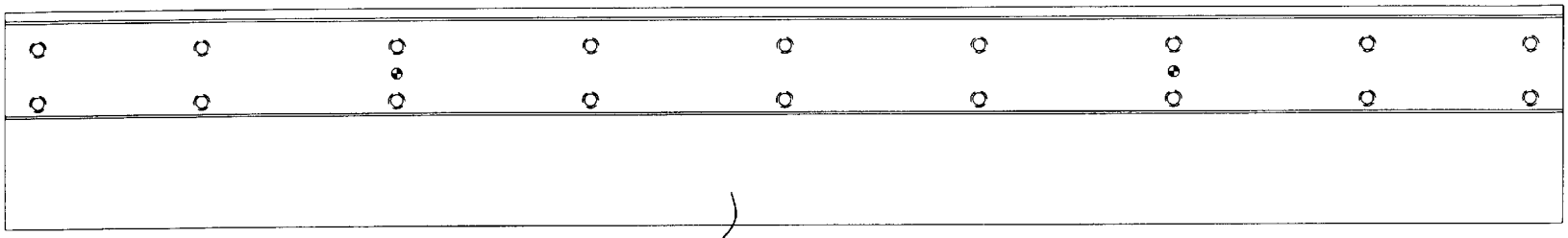
FIGS. 5*a*–5*c* show respective top, front and end views of a bottom blade of the fluid knife according to the present invention.
Figure 5B:
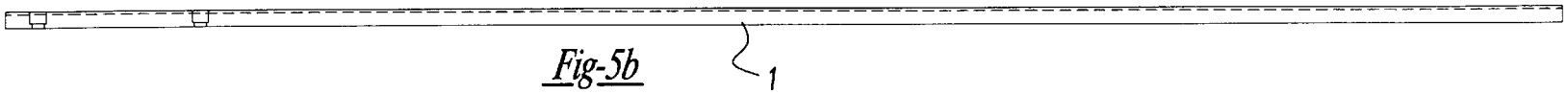
Figure 5C:
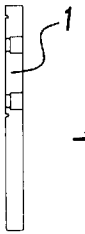
Figure 6A:
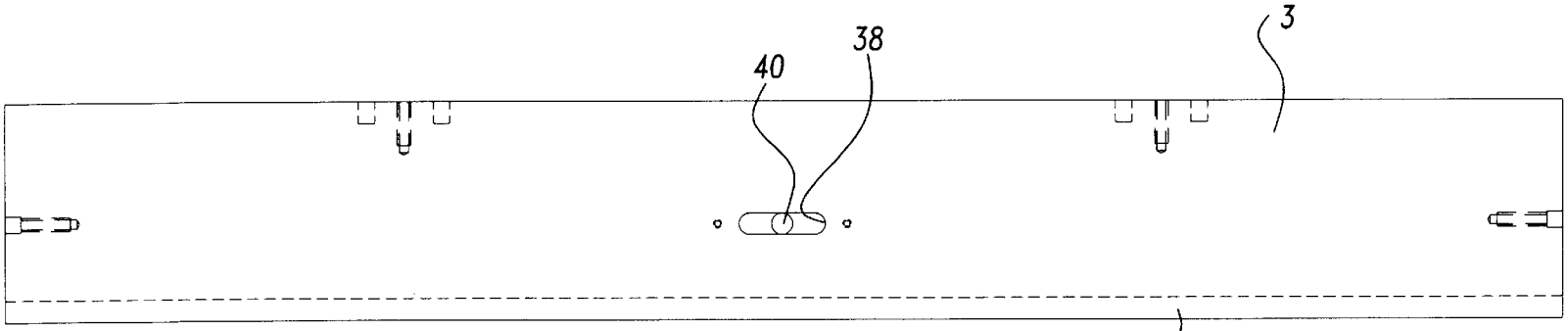
FIGS. 6*a*–6*c* show respective front, top and side views, respectively, of the front blade of the fluid knife according to the present invention.
Figure 6B:
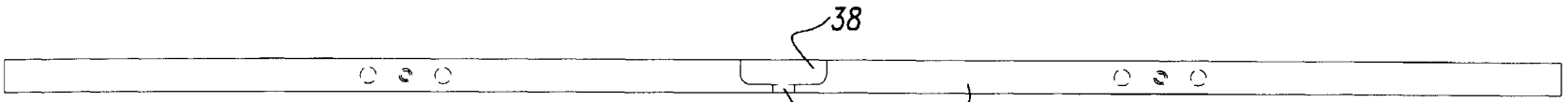
Figure 6C:
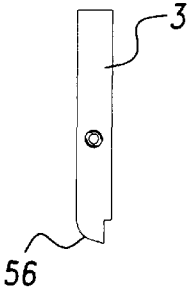
Figure 7A:
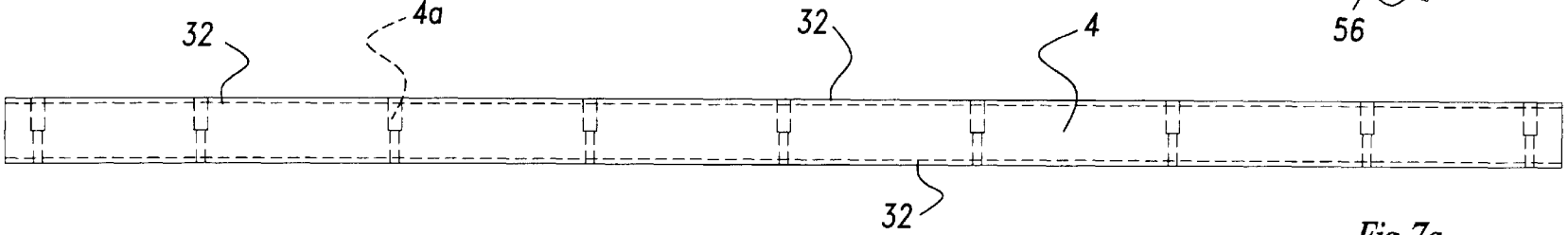
FIGS. 7*a*–7*c* show respective bottom, front and side views of a spacer of the fluid knife according to the present invention.
Figure 7B:
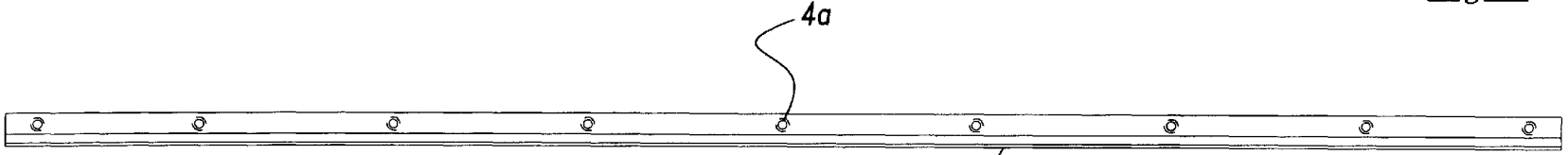
Figure 7C:
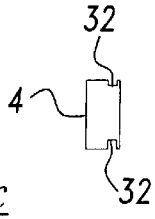
Figure 8A:
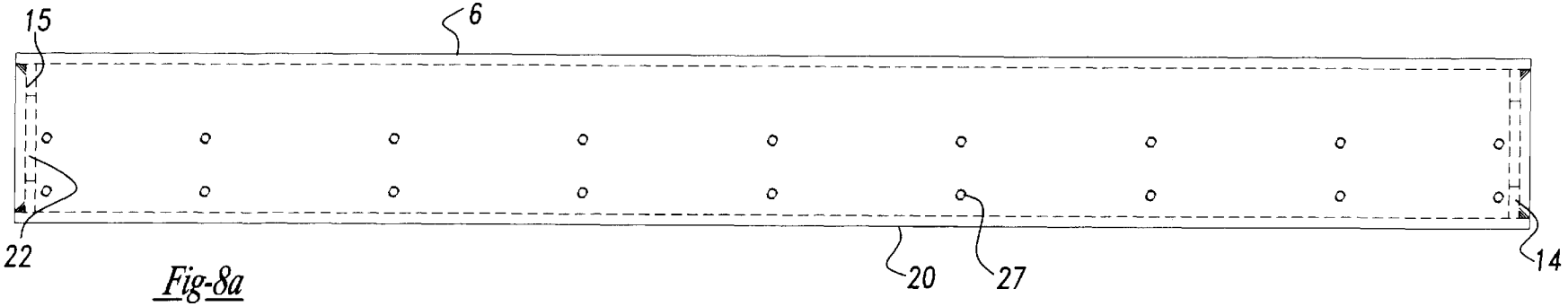
FIGS. 8*a*–8*c* show respective top, front and end views of a plenum of the fluid knife according to the present invention.
Figure 8B:
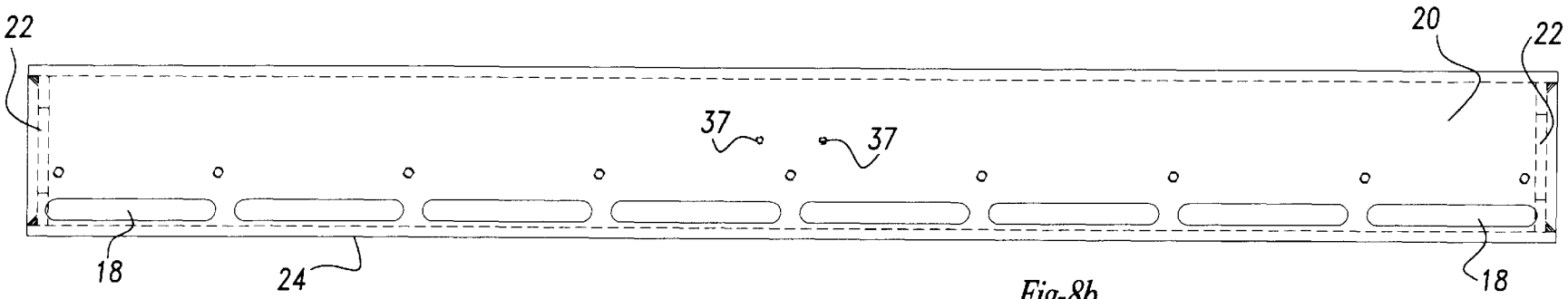
Figure 8C:
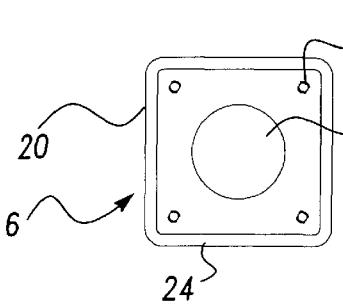
Figure 9B:
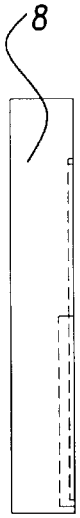
Figure 10A:
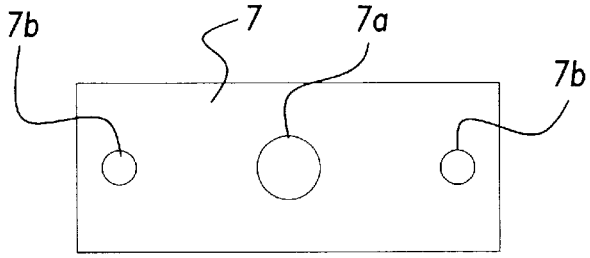
FIGS. 10*a*–10*b* show respective front and top views of an adjuster of the fluid knife according to the present invention.
Figure 10B:
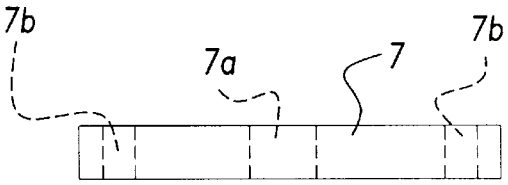
Figure 11A:
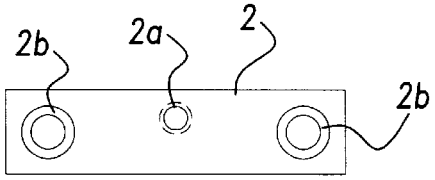
FIGS. 11*a*–11*b* show respective top and front views of a block of the fluid knife according to the present invention.
Figure 11B:
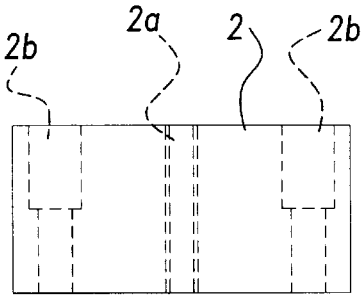
Figure 12A:
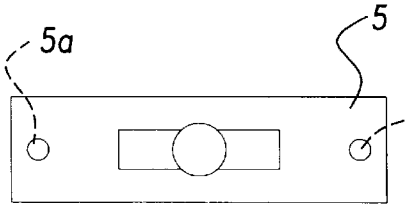
FIGS. 12*a*–12*c* show respectively rear, top and end views of a retainer of the fluid knife according to the present invention.
Figure 12B:
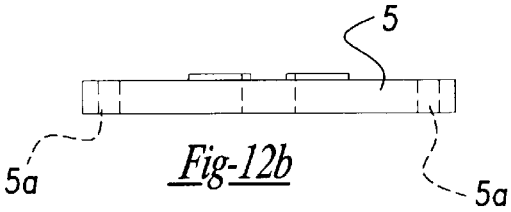
Figure 12C:
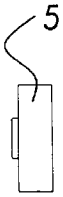
Figure 13A:
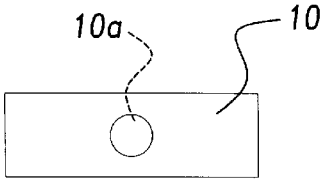
FIGS. 13*a*–13*b* show respective front and end views of a hold-down pin of the fluid knife according to the present invention.
Figure 13B:
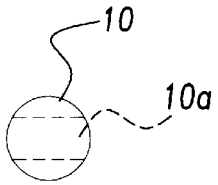
Figure 16:
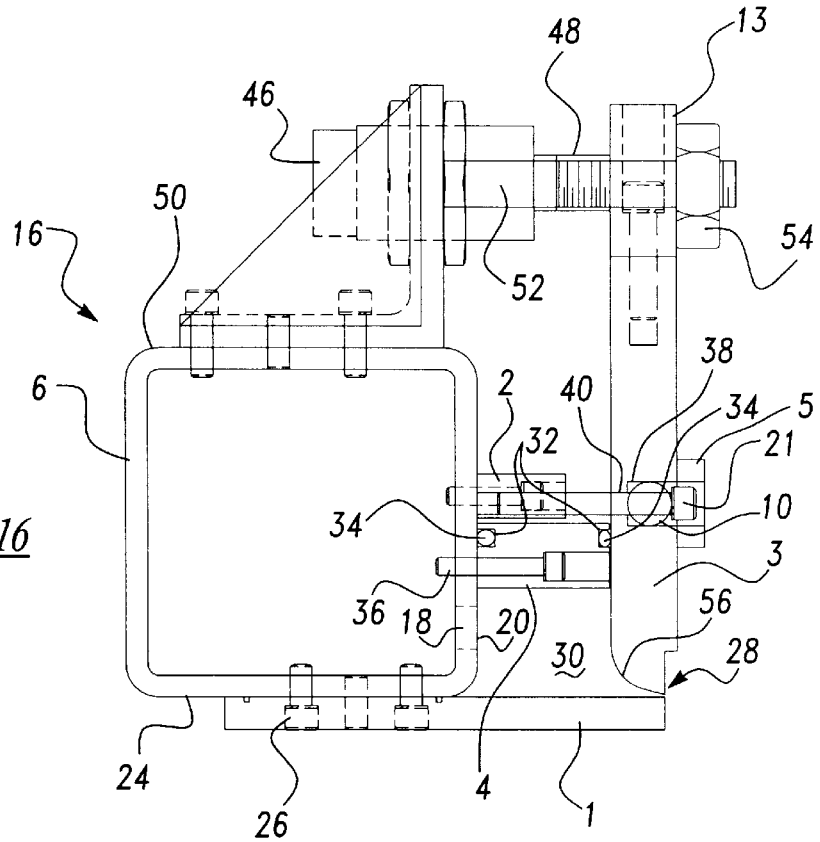
FIG. 16 is a cross-sectional view taken along lines 16—16 of FIG. 15.

Turning now to FIGS. 1 through 16, a fluid knife 16, according to the present invention, is shown. The fluid knife 16 includes a plenum 6. As shown, the plenum 6 is a section of substantially square tubing. In the disclosed embodiment, a piece of four by four by one quarter square tubing having a plurality of slots 18 cut along the lower edge of the front face 20 of the plenum 6, is shown. Further, the plenum 6 has opposed end walls 14, 15 having an aperture 22 on each end. A suitable fitting (not shown) is connected to the aperture 22 (see FIG. 8*c*) wherein the fluid is supplied to the interior of the plenum 6. Fluid enters the plenum 6 through the side or end walls 14, 15 and exits through a plurality of slots or openings 18 in the front face of the plenum 6. The plurality of openings 18 maintain the rigidity and integrity of the plenum 6 while providing a uniform fluid flow. Attached to the lower face or surface 24 of the plenum 6 is a bottom blade 1. The bottom blade 1 extends outwardly and is fixed to the lower face or surface 24 of the plenum 6 via a plurality of threaded fasteners 26 received by threaded apertures 27 located in the lower surface 24 of the plenum 6. The bottom blade 1 may be attached via several other methods including welding or extruding the bottom blade 1 along with the plenum 6. Attached to the front face 20 of the plenum 6 is a front blade 3. The front blade 3 cooperates with the bottom blade 1 to form a nozzle 28 (see FIG. 4) through which fluid exiting the plenum 6 is forced. As shown, a spacer 4 extends between the front blade 3 and the front face 20 of the plenum 6. The spacer 4 is positioned above the apertures or slots 18 in the front face 20 and cooperates with the front blade 3 and front face 20 of the plenum 6 along with the bottom blade 1 to form a second plenum or flow chamber 30. End caps 8, 9 seal the flow chamber 30 on each end, thus fluid entering into the flow chamber 30 exits the flow chamber 30 through the nozzle 28 formed by the front blade 3 and bottom blade 1. As shown, the end caps 8, 9 contain a groove 62 therein. The groove 62 accepts a seal member to seal the end cap 8 to the plenum 6.

The spacer 4 includes a pair of grooves 32 cut therein. The grooves 32 form an o-ring seat wherein an o-ring 34 placed within each groove 32 seals the spacer 4 to the plenum 6. The spacer 4 is secured to the front face 20 of the plenum 6 by a threaded fastener 36 extending through apertures 4*a* on the spacer 4 and received in the plenum 6. Other fastening means may be used. Once again, the spacer 4 may be extruded as part of the plenum 6. While such an extrusion may be suitable for aluminum plenums, particular uses may require that the plenum be manufactured of stainless steel, in which case such extrusion techniques may not be practical. The plenum may also be manufactured from plastic or other suitable material; e.g., fiberglass.

Turning now to the apparatus for pivotally mounting the front blade 3 to the plenum 6, the front blade 3 is mounted such that it moves outward, thus increasing the size of the nozzle 28 by increasing the gap between the front blade 3 and the bottom blade 1. As shown, the apparatus for pivotally mounting the front blade 3 includes a keeper 2. The keeper 2 is attached to the front face 20 of the plenum 6 by a plurality of threaded fasteners 36 extending through apertures 2*b* on the keeper 2 and threadably received in apertures 37 on the plenum 6. A retainer 5 and hold-down pin 10 cooperate with the keeper 2 to provide a pivot point about which the front blade 3 may pivot. As shown, the front blade 3 includes a slot 38 cut in the front face 20 of the front blade 3. The slot 38 forms a channel. The channel may be U-shaped, that is, have a radius bottom, or it may be angular. The slot 38 is of a size necessary to accept the hold-down pin 10, which in the present embodiment is cylindrical. The hold-down pin 10 is attached to the keeper 2 via a threaded fastener 21 extending through an aperture 40 in the front blade 3 and threadably received in the aperture 2*a* on the keeper 2.

The front blade 3 is further supported by a pair of threaded shoulder bolts 42. The bolts 42 extend through openings 43 located in the opposite end caps 8, 9 such that the front blade 3 pivots along or parallel its longitudinal axis. The shoulder portions 44 of the threaded shoulder bolts 42 provide pivot points within or between the adjuster 7 and the front blade 3. As shown, an adjuster 7 is secured to the end caps 8, 9. The adjuster 7 has an aperture 7*a* that is of a diameter equal to the shoulder portions 44 of the shoulder bolts 42. The adjuster further includes two additional bores 7*b*. The bores 7*b* are of a diameter greater than the threaded fasteners 60 used to secure the adjuster 7 to the end caps 8, 9. The increased diameter of the apertures 7*b* allows the adjuster 7 to be moved with respect to the end caps 8, 9 to properly position the front blade 3. A retainer 5 is secured to the front blade 3 through aperture 5*a* over the hold-down pin 10 to keep the hold-down pin 10 in position. As shown, the retainer 5 forms a cap or cover over the slot 38 to secure the hold-down pin 10 in position.

The front blade 3 is mounted such that it pivots outward; i.e., away from the plenum 6. Pivoting outward causes an increase in nozzle size; i.e., it increases the size of the opening between the front blade 3 and the bottom blade 1. Increasing the size of the opening enables any particulate matter which may be trapped in the nozzle 28 to be purged or flushed out.

A power cylinder 46 attached to the top of the plenum 6 provides a force to maintain the front blade 3 in a closed or operating position wherein the nozzle 28 remains at an operating size. The power cylinder 46 may either be an air or hydraulic type. Other types of apparatus' for driving a rod in a reciprocal manner may also be used. As shown herein, the power cylinder 46 includes a rod 48 engaging a block 13 attached to the upper surface 50 of the front blade 3. The rod 48 is attached such that actuation of the power cylinder 46 causes the front blade 3 to pivot about the hold-down pin 10 and shoulder bolts 42. It should be appreciated that the force or presence of the fluid within the flow chamber 30 acts to drive the front blade 3 outward. Outward movement of the front blade is prevented by the rod 48 of the power cylinder 46. When the power cylinder 46 is deenergized, the front blade 3 pivots outward thus increasing the size of the nozzle 28.

Figure 14:
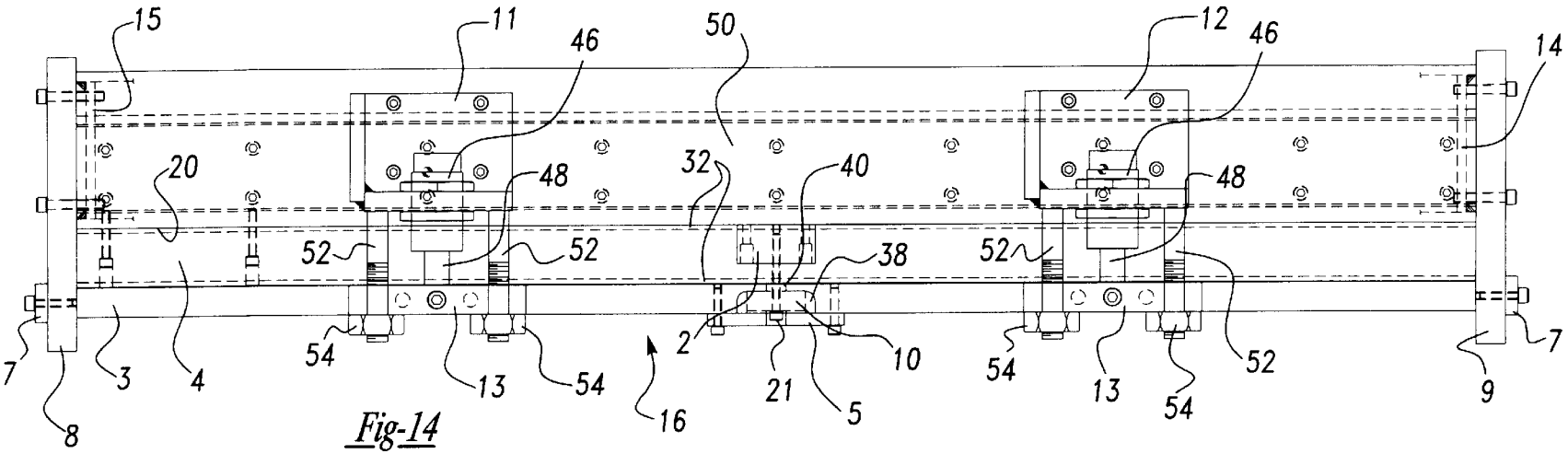
FIG. 14 shows a top view of an alternative embodiment of a fluid knife according to the present invention.
Figure 15:
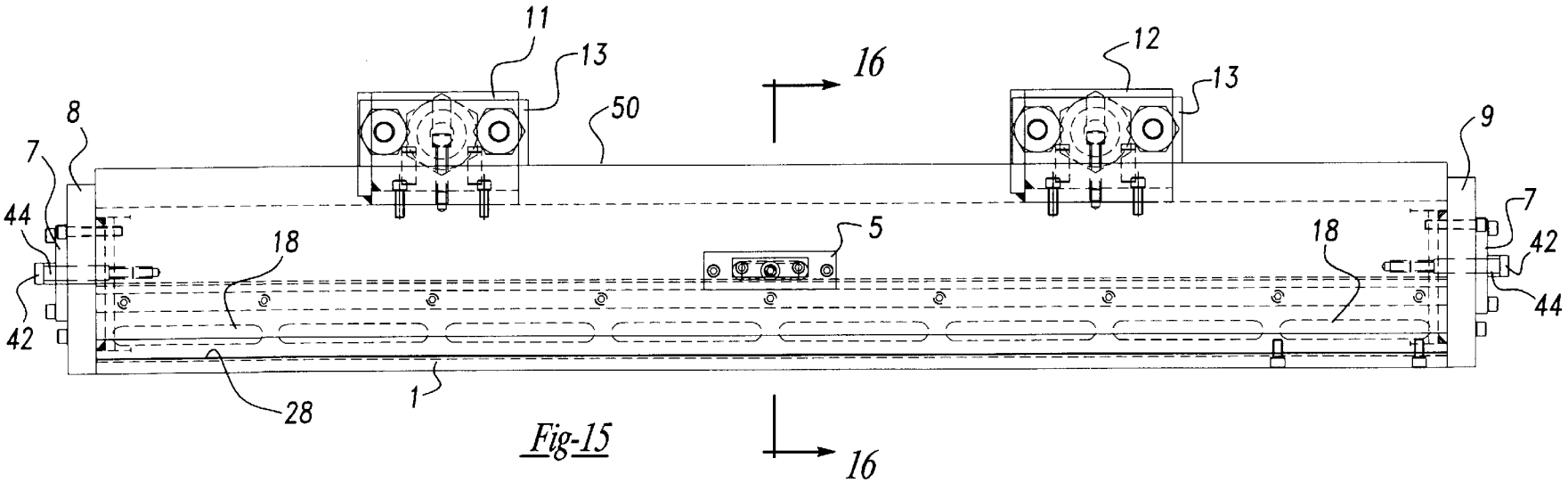
FIG. 15 is a front view of the embodiment of the fluid knife shown in FIG. 14.

As shown in FIGS. 14 and 15, an adjustment member, shown as a pair of threaded rods 52 are attached to a bracket 11 supporting the power cylinder 46. The threaded rods 52 extend through the block 13 and are coupled to the block 13 by a pair of stop nuts 54. The stop nuts 54 provide a stop to properly align the front blade 3; i.e., to adjust the size of the opening of the nozzle 28 in the closed or operating position. Energizing the power cylinder 46 operates to force the block 13 outward, thus positioning the front blade 3 in the operating position. When the power cylinder 46 is operated in a reverse manner or the cylinder is de-energized, the pressure of the fluid in the flow chamber 30 urges the front blade 3 outward increasing the nozzle 28 opening allowing any particulate matter to be purged or flushed from the system. When the power cylinder 46 is energized, it operates to drive the front blade 3 forward such that the block 13 engages the stop nut 54 and the front blade 3 rests squarely on the spacer 4. The o-rings 34 positioned on the spacer 4 seal the blade/spacer interface.

The front blade 3 cooperates with the bottom blade 1 to form a nozzle 28 as set forth above. In the operating position, the nozzle 28 is formed by a gap between the front 3 and bottom 1 blades of approximately thirty thousandths of an inch (0.030). During operation, it is possible for particulate matter not removed by the filter system, to become lodged in the nozzle 28 opening. If this should occur, it prevents fluid flow at that point which creates streaking or improper cleaning of the workpiece passing through the treatment apparatus. In order to remove such particulate, the front blade 1 is pivoted outward to enlarge the nozzle 28 opening to approximately one hundred thousandths of an inch (0.100) creating an opening large enough to flush or purge any unwanted particulate matter trapped in the nozzle 28. The purging is accomplished by releasing the pressure applied by the power cylinder 46 allowing fluid pressure in the chamber 30 to open the nozzle 28 and allow particulate matter to be flushed out. Because the amount of pivoting required to open the nozzle 28 is small, the front blade 3 remains in contact with the spacer 4 and the o-ring 34 maintains a seal during the purging process. Once the purging process is complete, the power cylinder 46 is actuated or energized to force the front blade 3 against the lock nuts 54, thereby closing the nozzle 28 to the desired size.

Turning now to the nozzle 28, the shape of the nozzle 28 includes a radius 56 cut in the rear surface/lower edge of the front blade 3. As shown, the bottom blade 1 is flat and results in a thirty thousandth of an inch (0.030) gap between the two blades 3, 1. Such a blade design provides a fluid stream exiting the nozzle 28 at roughly a fifteen degree angle. While shown herein as a fifteen degree angle, the angle can be anywhere from 12 to 20 degrees. However, it has been determined empirically that a fluid stream angle of 15 degrees reduces drag-out; i.e., the amount of fluid that remains on the workpiece after it passes the fluid knife 16.

The invention has been described in an illustrative manner. It is to be understood that the terminology which has been used is intended to be in the nature of words of description rather than of limitation.

Many modifications and variations of the invention are possible in light of the above teachings. Therefore, within the scope of the appended claims, the invention may be practiced other than as specifically described.

I claim:

1. A fluid knife comprising:

a plenum receiving fluid from a fluid source;

a bottom blade attached to said plenum;

a front blade pivotally attached to said plenum, said front blade cooperating with said bottom blade to form a flow chamber, said plenum having a plurality of openings therein for supplying fluid from said plenum to said flow chamber wherein said front blade and said bottom blade cooperate to form a nozzle such that fluid entering said flow chamber from said plenum exits said flow chamber through said nozzle;

end caps positioned at each end of said plenum wherein said front blade is pivotally attached to said end caps;

an adjuster mounted to each of said end caps and a pivot member interconnecting said adjuster with said front blade such that adjustment of said adjuster on said end cap adjusts the position of said front blade in relation to the position of said bottom blade to position said front blade in a first, operating position and correspondingly position said nozzle at an operating size; and an actuator engaging said front blade such that said actuator pivots said front blade between said first, operating position and a second, purge position.

2. A fluid knife as set forth in claim 1 including a spacer positioned between said front blade and said plenum, said spacer forming an upper boundary of said flow chamber wherein said spacer includes a groove having a seal positioned therein for sealing the interface between said front blade and said spacer during pivotal movement of said front blade.

3. A fluid knife as set forth in claim 1 including a channel formed in said front blade, said front blade further including an aperture extending through said channel; a keeper mounted to a front face of said plenum, a hold-down pin having an aperture therein and a fastener extending through said aperture in said hold-down pin and said aperture in said front blade and threadably received in said keeper such that said hold-down pin is secured within said channel.

4. A fluid knife as set forth in claim 1 wherein said actuator includes a power cylinder secured to the plenum, a rod extending from said power cylinder engages said front blade such that actuation of the power cylinder enables the front blade to pivot.

5. A fluid knife as set forth in claim 1 wherein said nozzle is formed by said front blade including a radius cut on the rear surface/lower edge of said front blade and said bottom blade having a flat upper surface, the respective surfaces cooperating to form said nozzle.

6. A fluid knife comprising:

a plenum receiving fluid from a fluid source;

a bottom blade attached to said plenum;

a front blade pivotally attached to said plenum, said front blade cooperating with said bottom blade to form a flow chamber, said plenum having a plurality of openings therein for supplying fluid from said plenum to said flow chamber wherein said front blade and said bottom blade cooperate to form a nozzle such that fluid entering said flow chamber from said plenum exits said flow chamber through said nozzle;

an actuator engaging said front blade such that said actuator moves said front blade between a first, operating position and a second, purge position; and an adjustment member connected to one end of a bracket mounted to said plenum, said adjustment member extending through an aperture of a mounting block fixed to said front blade and a stop nut adjustably positioned on said adjustment member to adjust the size of the opening of the nozzle when said front blade is located in said first, operating position.

7. A fluid knife comprising:

a plenum receiving fluid from a fluid source;

a bottom blade attached to send plenum;

a front blade attached to said plenum wherein said front blade moves between a first, operating position and a second, purge position;

a nozzle formed by said bottom blade cooperating with said front blade wherein when said front blade is in said first, operating position, said front blade is positioned proximate said bottom blade such that a gap exists between said front blade and said bottom blade, said gap forming said nozzle through which fluid exits said fluid knife;

a stop connected to said plenum, said front blade engaging said stop when said front blade is in said first, operating position and wherein said nozzle remains at an operating size;

an actuator connected to said front blade such that when said actuator is energized said actuator engages said front blade to hold said front blade against said stop in said first, operating position and when said actuator is de-energized, said front blade moves outward and said front blade opens to said second, purge position.

8. A fluid knife as set forth in claim 7 wherein said front blade is pivotally connected to said plenum; and a spacer positioned between said plenum and said front blade, wherein said front blade, said bottom blade and said spacer cooperate with a portion of said plenum to form a flow chamber receiving fluid from said plenum.

9. A fluid knife as set forth in claim 8 including a pair of end caps attached to said plenum, said front blade pivotally connected to said plenum through said end caps.

10. A fluid knife as set forth in claim 9 including a pair of adjusters attached to said end caps, said adjusters connected to said end caps and receiving a shoulder bolt extending through said adjuster and threadably secured within said front blade, said shoulder bolt forming an axis about which said front blade pivots, said adjusters adjustably positioned on said end caps such that movement of said adjusters on said end caps adjusts the position of said front blade in relation to the position of said bottom blade.

11. A fluid knife as set forth in claim 7 wherein said actuator includes a power cylinder connected to said plenum, said power cylinder engaging said front blade.

12. A fluid knife as set forth in claim 7 including a spacer positioned between said front blade and said plenum, said spacer further including a groove therein and a seal positioned within said groove and sealing the interface of said front blade and said spacer during pivotal movement of said front blade.

13. A fluid knife as set forth in claim 7 wherein said stop includes a threaded rod connected to one end of a bracket mounted to said plenum, said threaded rod extending through an aperture on said front blade, a stop nut adjustably positioned on said threaded rod engaging said front blade to properly align the front blade and adjust the size of the opening of the nozzle.

14. A fluid knife comprising:

a plenum for receiving fluid from a fluid source;

a bottom blade attached to said plenum;

an end cap attached at each end of said plenum, said end caps sealing the respective ends of said plenum;

a front blade pivotally attached to said end caps through an adjustor attached to each of said end caps, said adjuster adjustably positioned on said end caps wherein a pivot pin in the form of a shoulder bolt extends through and is supported by said adjuster and connects to said front blade;

a spacer, said spacer attached to said plenum and extending between said plenum and said front blade, said spacer including a groove therein;

a seal placed in said groove, said seal cooperating with said front blade to seal said front blade to said spacer wherein said front blade, said spacer and said bottom blade cooperate to form a flow chamber, said plenum having a plurality of openings therein for supplying fluid from said plenum to said flow chamber, said front blade and said bottom blade positioned proximate one another and establishing an opening therebetween, said opening forming a nozzle wherein said fluid entering said flow chamber from said plenum exits said flow chamber through said nozzle; and an actuator attached to said plenum engaging said front blade, such that said actuator moves said front blade between two discreet positions, a first, operating position and a second, purge position.

15. A fluid knife as set forth in claim 14 including a channel formed in said front blade, an aperture in said front blade extending through said channel; a keeper mounted to a front face of said plenum, a hold-down pin having an aperture therein and a fastener extending through the aperture in said hold-down pin and through the aperture in said front blade and threadably received in said keeper such tht said hold-dowm pin is secured within said channel and that said front blade pivots about said hold-down pin.

16. A fluid knife as set forth in claim 14 including a stop having a threaded rod connected on one end to a bracket mounted to said plenum, said threaded rod extending through an aperture on said front blade and a stop nut threadably engaging said threaded rod to define said first, operating position of said front blade when said front blade engages said stop nut.

17. A fluid knife as set forth in claim 14 wherein said actuator includes a power cylinder secured to the plenum, said power cylinder having a rod thereon, said rod engaging said front blade and adapted to pivot said front blade.

18. A fluid knife as set forth in claim 17 wherein said stop and said adjustor cooperate to position said front blade at said first, operating position such that said actuator positions said front blade at said first, operating position.

19. A fluid knife as set forth in claim 14 wherein said nozzle is formed by said front blade including a radius cut on the rear surface/lower edge of said front blade and said bottom blade having a flat upper surface, the respective surfaces cooperating to form said nozzle.

* * * * *